United States Patent [19]

Crum et al.

[11] Patent Number: 5,019,184

[45] Date of Patent: May 28, 1991

[54] CORROSION-RESISTANT NICKEL-CHROMIUM-MOLYBDENUM ALLOYS

[75] Inventors: James R. Crum, Ona; Jon M. Poole, Barboursville; Edward L. Hibner, Ona, all of W. Va.

[73] Assignee: Inco Alloys International, Inc., Huntington, W. Va.

[21] Appl. No.: 467,810

[22] Filed: Jan. 26, 1990

Related U.S. Application Data

[63] Continuation-in-part of Ser. No. 338,965, Apr. 14, 1989, abandoned.

[51] Int. Cl.[5] ..... C22F 1/10

[52] U.S. Cl. ..... 148/13; 148/427; 420/442; 420/451; 420/453

[58] Field of Search ..... 148/13, 427; 420/442, 420/451, 453

[56] References Cited

U.S. PATENT DOCUMENTS

| | | | |
|---|---|---|---|
| 3,160,500 | 12/1964 | Eiselstein et al. | 148/428 |
| 3,203,792 | 8/1965 | Scheil et al. | 420/454 |
| 4,080,201 | 3/1978 | Hodge et al. | 420/446 |
| 4,168,188 | 9/1979 | Asphahani | 148/427 |
| 4,533,414 | 8/1985 | Asphahani | 148/427 |

OTHER PUBLICATIONS

W. Z. Friend, "Corrosion of Nickel and Nickel-Base Alloys", pp. 292-367; pub'd by John Wiley & Sons (1980).

*Primary Examiner*—R. Dean
*Assistant Examiner*—Margery S. Phipps
*Attorney, Agent, or Firm*—Francis J. Mulligan, Jr.; Edward A. Steen

[57] ABSTRACT

A homogenizaton heat treatment for enhancing crevice and pitting corrosion resistance minimizes the formation of Mu phase in nickel-base alloys of high combined percentages of chromium, e.g., 19 to 23% and molybdenum, e.g., 14 to 17%, particularly together with tungsten. Also described is an advantageous alloy composition containing less than 2.5% iron, low carbon and a titanium to carbon ratio greater than 1 which is particularly adapted to be effectively treated by the homogenization heat treatment.

15 Claims, 2 Drawing Sheets

FIG. 2

CORROSION-RESISTANT NICKEL-CHROMIUM-MOLYBDENUM ALLOYS

CROSS REFERENCE TO RELATED APPLICATION

This application is a continuation-in-part of Ser. No. 338,965, filed Apr. 14, 1989, now abandoned.

The present invention is directed to corrosion-resistant nickel alloys and more particularly to nickel-base alloys of high chromium/molybdenum content which are capable of affording outstanding corrosion resistance in a host of diverse corrosive media.

INVENTION BACKGROUND

As is generally recognized in the art, nickel-base alloys are used for the purpose of resisting the ravages occasioned by various corrodents. Notable in this regard are the nickel-chromium-molybdenum alloys as is set forth in the Treatise "Corrosion of Nickel and Nickel-Base Alloys", pages 292–367, authored by W.Z. Friend and published by John Wiley & Sons (1980). Among such alloys might be mentioned INCONEL ® alloy 625, INCOLOY ® alloy 825, Alloy C-276, Multiphase ® alloy MP35N, HASTELLOY ® alloys C, C-4 and the recently introduced alloy C-22 ®.

Alloys of the type mentioned above are exposed to service conditions where, inter alia, severe crevice and pitting corrosion are encountered as well as general corrosion. Representative of such situations would be (a) pollution control applications, e.g., flue gas desulfurization scrubbers for coal fired power plants, (b) chemical processing equipment such as pressure vessels and piping, (c) the pulp and paper industry, (d) marine environments, particularly sea water, (e) oil and gas well tubing, casings and auxiliary hardware, etc. This is not to say that other forms of corrosive attack do not come into play under such operating conditions.

In endeavoring to develop a highly useful and practical alloy for the above applications/service conditions, there seems to have been an emphasis in the direction of using chromium and molybdenum levels as high as possible, and often together with tungsten. (See, for example, Table I below which gives the nominal percentages of various well known commercial alloys.)

TABLE I

| Alloy | Cr plus Mo plus W |
|---|---|
| Alloy 625* | 21.5 Cr + 9 Mo |
| C-276* | 15.5 Cr + 16 Mo + 3.75 W |
| MP35N* | 20 Cr + 10 Mo |
| C* | 15.5 Cr + 16 Mo + 3.75 W |
| C-4* | 18 Cr + 15.5 Mo |
| C-22 | 22 Cr + 13 Mo + 3 W |
| X* | 22 Cr + 9 Mo + 0.6 W |

*Page 296 of W. Z. Friend treatise: Note Co, Cb, Ta, etc. are often found in such materials.

While high chromium, molybdenum and tungsten would be desirable, it can also give rise to a morphological problem, to wit, the formation of the Mu phase, a phase which forms during solidification and on hot rolling and is retained upon conventional annealing. There is perhaps not complete agreement as to what exactly constitutes Mu phase, but for purposes herein it is deemed to be appreciably a hexagonal structure with rhombohedral symmetry phase type comprised of (Ni, Cr, Fe, Co, if present,)$_3$ (Mo, W)$_2$. P phase, a variant of Mu with an orthorhombic structure, may also be present.

In any case, this phase can impair the formability and detract from corrosion resistance since it depletes the alloy matrix of the very constituents used to confer corrosion resistance as a matter of first instance. It is this aspect to which the present invention is particularly directed. It will be observed from Table I that when the chromium content is, say, roughly 20% or more the molybdenum content does not exceed about 13%. It is thought that the Mu phase may possibly be responsible for not enabling higher molybdenum levels to be used where resistance to crevice corrosion is of paramount concern.

The foregoing aside, in striving to evolve the more highly corrosion resistant alloy, other considerations must be kept in focus. That is to say, corrosion resistance notwithstanding, such alloys not only must be hot workable but also cold workable to generate required yield strengths, e.g., upwards of 689 to 862 or 1035 MPA, together with adequate ductility. In addition, alloys of the type under consideration are often subjected to a welding operation. This brings into play corrosive attack at the weld and/or heat-affected zones (HAZ), a problem more pronounced where elevated operating temperatures are encountered, e.g., in the chemical process industry. Without a desired combination of mechanical properties and weldability an otherwise satisfactory alloy could be found wanting.

BRIEF DESCRIPTION OF THE DRAWINGS

The beneficial effect of the present invention is illustrated by a comparison of the figures of the drawing in which.

INVENTION SUMMARY

Figure 1:
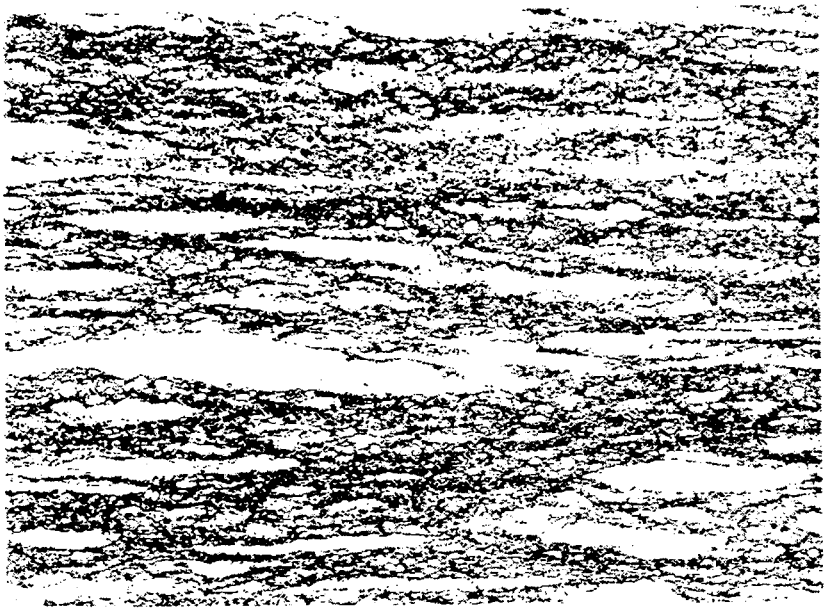
FIG. 1 is a reproduction of a photomicrograph at 500 power of an alloy conventionally processed.

It has now been discovered that a special heat treatment, a homogenization treatment as described more fully herein, minimizes the tendency of the Mu phase to form such that higher combined percentages of chromium, molybdenum, e.g., 19–22% Cr, 14–17% Mo, particularly together with tungsten, e.g., up to 4%, can be utilized. As a consequence, crevice/pitting corrosion resistance in various media is improved and manufacturing operations, including both hot and cold working, can be carried forth to produce product forms such as plate, strip and sheet which, in turn, can be fabricated into desired end products.

INVENTION EMBODIMENT

Generally speaking and in accordance herewith, the present invention contemplates the production of nickel-base alloys high in total percentage of chromium, molybdenum and tungsten having a morphological structure characterized by the absence of detrimental quantities of the subversive Mu phase, the alloys being subjected to a homogenization (soaking) treatment above 1149° C, e.g. at 1204° C. prior to hot working and for a period sufficient to inhibit the formation of deleterious Mu phase, i.e., at least about 5 hours. Advantageously, this heat treatment is carried out in two stages as described infra. The invention also contemplates the alloys in the condition resulting for said homogenization (soaking) treatment and subsequent conventional processing.

Alloy Compositions

In terms of chemical composition it is preferred that the nickel-base alloy contain in percent by weight, at least about 19% chromium and at least about 14 or 14.25% molybdenum, together with at least 1.5 or 2% tungsten, the more preferred ranges being about 20 to 23% chromium, 14.25 or 14.5 to 16% molybdenum and about 2.5 to 4% tungsten. It is still further preferred that molybdenum levels of, say, 15 or 15.25 to 16%, be used with the chromium percentage of 19.5 to 21.5%. Conversely, the higher chromium percentage of, say, 21.5 to 23% should be used with molybdenum contents of 14 to 15%. While chromium levels of up to 24 or 25% might be employed and while the molybdenum may be extended up to 17 or 18%, it is deemed that excessive Mu phase may be retained during processing through such compositions might be satisfactory in certain environments.

With regard to other constituents, carbon should not exceed about 0.05% and is preferably maintained below 0.03 or 0.02%. In a most preferred embodiment it should be held to less than 0.01%, e.g. 0.005% or less. Titanium, although it may be absent, is usually present in the alloy in the range of about 0.01 to 0.25% and, as set forth hereinafter, is advantageously present in a minimum amount correlated to the carbon content. Iron can be present up to 10% and it is to advantage that it be from 0 to 6 or 7%. Auxiliary elements, if present, are generally in the range of up to 0.5% of manganese and up to 0.25% silicon, advantageously less than 0.35 and 0.1%, respectively; up to 5% cobalt, e.g., up to 2.5%; up to 0.5 or 1% copper; up to 0.5 or 0.75% niobium; up to 0.01% boron, e.g., 0.001 to 0.007%; up to 0.1 or 0.2% zirconium; up to 0.5% aluminum, e.g., 0.05 to 0.3%; with such elements as sulfur, phosphorus being maintained at low levels consistent with good melt practice. Sulfur should be maintained below 0.01%, e.g., less than 0.0075%.

Homogenization Treatment

The homogenization treatment is a temperature-time interdependent relationship. The temperature should exceed 1149° C. and is advantageously at least about 1190° C., e.g., 1204° C., since the former (1149° C.) is too low in terms of practical holding periods. On the other hand a temperature much above 1316° C. would be getting too close to the melting point of the alloys contemplated and is counter-productive Holding for about 5 or 10 to 100 hours at 1204° C. and above gives satisfactory results. However, it is deemed beneficial that a temperature of 1218° to 1245° or 1260° C. be employed for 5 to 50 hours. As will be understood by the artisan, lower temperatures require longer holding times with the converse being true, it being recognized that not only is there a time-temperature interdependency, but section size (thickness) and segregation profile of the material treated also enters into the relationship. As a general rule, holding for about 1 hour for each 2.54cm in thickness at 1204°-1260° C. plus 5 to 10 hours additional gives satisfactory results.

In addition to the above, it is preferable to homogenize in at least two stages, e.g., 5 to 50 hours at, say, 1093° to 1204° C. and then 5 to 72 hours at above 1204° C., e.g., 1218° C. and above. This is to minimize segregation defects. The first stage treatment tends to eliminate low melting point eutectics, and the higher temperature second stage treatment encourages more rapid diffusion resulting in a smaller degree of segregation.

Hot Working/Annealing

Hot working can be carried out over the temperature range upwards of 1038° C., particularly 1121° or 1149° C., to 1218° C. During the course of hot working, e.g., hot rolling, temperature does decrease and it may be prudent to reheat to temperature. With regard to the annealing operation, in accordance herewith it is desirable to use high temperatures to ensure resolutionizing as much Mu phase as possible. In this regard, the anneal, while it can be conducted at, say, 1149° C., it is more advantageous to use a temperature of 1177° C., e.g., 1191° C., to 1216° C. or 1232° C.

The following information and data are given to afford those skilled in the art a better perspective in respect of the invention.

A series of 45 Kg. melts were prepared using vacuum induction melting, the compositions of which are given in Table II. Alloys 1-11 were each cast into separate 23 Kg ingots. The ingot "A" series (non homogenized) was soaked at 1149° C. for 4 hours prior to hot rolling which was also conducted at 1149° C. The series "B" ingots were soaked at 1204° C. for 6 hours whereupon the temperature was raised to 1246° C., the holding time being 10 hours. (This is representative of the two-stage homogenization treatment.) The furnace was then cooled to 1149° C. and the alloys were hot rolled to plate at that temperature. Ingots were reheated at 1149° C. while hot rolling to plate. Plate was annealed at 1204° C. for 15 minutes and water quenched prior to cold rolling to strip (Tables V, XIII and XIV). Sheet was produced from strip by cold rolling 33% and then 42% to a final thickness of about 0.25 cm. This was followed by annealing at 1204° C. for 15 minutes and then water quenching. Air cooling can be used.

Microstructure analysis (and hardness in Rockwell units) are reported in Tables III, IV and V for the as-hot-rolled plate, hot rolled plus annealed plate and cold rolled plus annealed strip conditions, respectively. Alloys 1-7 and 10 were hot rolled to 5.72 cm square and overhauled prior to rolling to 0.66-1.09 cm plate. Alloys 8 and 9 were hot rolled directly to 1.65 cm plate with no overhaul.

Figure 2:
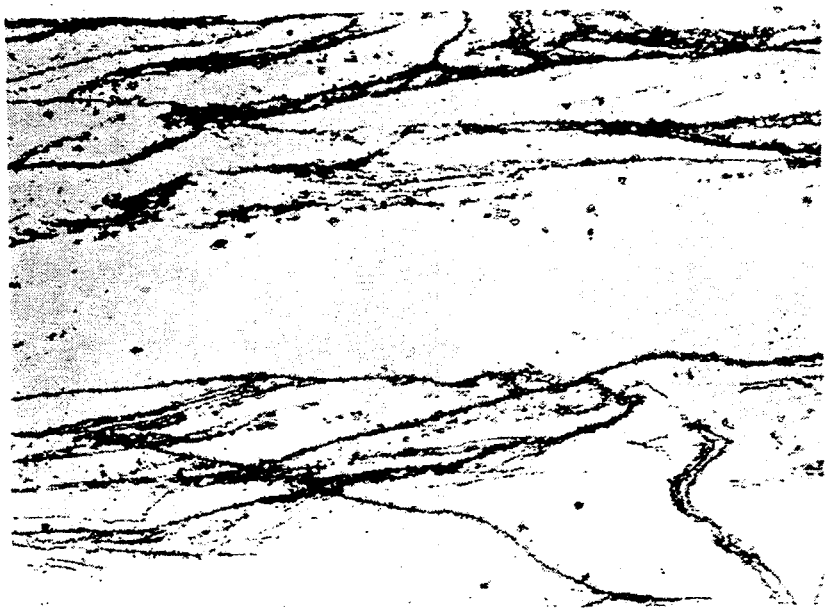
FIG. 2 is a similar reproduction at the same magnefication of a photomicrograph of the same alloy processed using the homogenization treatment of the present invention.

(Highly alloyed Alloy 7 did not satisfactorily roll to plate for reasons unknown. This being investigated since based on experience it is considered that acceptable plate should be produced.) While cracking occurred in some heats, it was not detrimental. More important are the resulting microstructures. As can be seen from Table III, microstructure was significantly affected in the positive sense by the homogenization treatment, the size and quantity of Mu phase being considerably less as a result of the homogenization treatment. This is graphically illustrated by a comparison of the photomicrograph FIGS. 1 (not homogenized) and 2 (homogenized) concerning Alloy 2. Magnification is at 500X, the etchant being chromic acid, electrolytic. FIG. 2 depicts only a slight amount of fine Mu particles.

Of note is the fact that the homogenized compositions manifested lower hardness levels than the non-homogenized materials.

TABLE II

| | Chemical Composition | | | | | | | | | | | |
|---|---|---|---|---|---|---|---|---|---|---|---|---|
| Alloy | Cr | Mo | W | Fe | C | Si | Mn | B | Al | Ti | S | Ni |
| 1 | 20.19 | 15.19 | 3.43 | 4.65 | .004 | .004 | .24 | .0010 | .15 | .020 | .001 | Bal. |
| 2 | 21.01 | 15.25 | 3.45 | 4.65 | .004 | .010 | .24 | .0010 | .15 | .024 | .012 | Bal. |
| 3 | 22.15 | 15.42 | 2.66 | 4.69 | .005 | .005 | .24 | .0010 | .15 | .025 | .0008 | Bal. |
| 4 | 21.12 | 15.82 | 3.39 | 4.61 | .004 | .006 | .24 | .0011 | .15 | .024 | .0006 | Bal. |
| 5 | 20.94 | 16.35 | 3.47 | 4.67 | .005 | .000 | .24 | .0014 | .15 | .032 | .0010 | Bal. |
| 6 | 20.93 | 15.40 | 3.92 | 4.65 | .005 | .008 | .24 | .0012 | .16 | .032 | .0009 | Bal. |
| 7 | 21.12 | 16.20 | 3.94 | 4.65 | .005 | .000 | .25 | .0013 | .15 | .026 | .0007 | Bal. |
| 8 | 20.59 | 14.71 | 3.15 | 4.66 | .003 | .060 | .25 | .0013 | .16 | .026 | .001 | Bal. |
| 9 | 20.41 | 14.76 | 3.18 | 4.70 | .004 | .058 | .24 | .0021 | .16 | .044 | .001 | Bal. |
| 10 | 20.76 | 14.54 | 3.67 | 4.50 | .002 | .046 | .25 | .0012 | .14 | .02 | .001 | Bal. |
| 11 | 20.76 | 14.70 | 3.66 | 4.53 | | .042 | .25 | .0012 | .14 | .02 | — | Bal. |

TABLE III

| | | | | As-Hot-Rolled Plate Properties | | | | | | |
|---|---|---|---|---|---|---|---|---|---|---|
| | | | | | As Hot Rolled @ 1149° C. (2nd Rolling) | | | | | |
| | | | | | A (No Homogenization) | | | B (Homogenized 2275° F.) | | |
| | % by Wt. | | | 1149° C. Initial Hot Roll (A/B) | Gauge | | | Gauge | | |
| Alloy | Cr | Mo | W | (cm) | (cm) | Rc | *Micro | (cm) | Rc | *Micro |
| 1 | 20.2 | 15.2 | 3.4 | 5.7/5.7 | 0.767 | 41 | 1, large, mod. | 0.838 | 38 | 1, fine, light |
| 2 | 21.0 | 15.2 | 3.4 | 5.7/5.7 | 0.657 | 44 | 1, large, mod. | 0.876 | 22 | 1, fine mod. |
| 3 | 22.2 | 15.4 | 2.7 | Stop/Stop | 0.858 | 36 | 2, large, heavy | 0.721 | 30 | 2, fine, mod. |
| 4 | 21.1 | 15.8 | 3.4 | 5.7/5.7 | 0.739 | 34 | 1, large, mod. | 0.742 | 42 | 2, fine, heavy |
| 5 | 20.9 | 16.4 | 3.5 | Stop/Stop | 1.097 | 31 | 1-2, large, heavy | 0.864 | 35 | 2, fine, heavy |
| 6 | 20.9 | 15.4 | 3.9 | 5.7/Stop | 0.777 | 43 | 1, large, mod. | 0.800 | 25 | 2, fine, mod. |
| 7 | 21.1 | 16.2 | 3.9 | 5.7/Stop | 0.876 | 36 | 1, large heavy | 2.985 | 26 | Different Phase |
| 8 | 20.6 | 14.7 | 3.2 | 1.65/1.65 | 0.737 | 35 | 1, fine heavy | — | — | — |
| 9 | 20.4 | 14.7 | 3.1 | 1.65/1.65 | — | — | | 0.737 | 26 | 1, fine, light |

*Microstructure:
Type 1 - Large elongated grains with intergranular and intragranular Mu, large or fine particles, light, moderate or heavy overall precipitation.
Type 2 - Small equiaxed grains with intergranular and intragranular Mu, large or fine particles, light, moderate or heavy overall precipitation.

Figure 3:
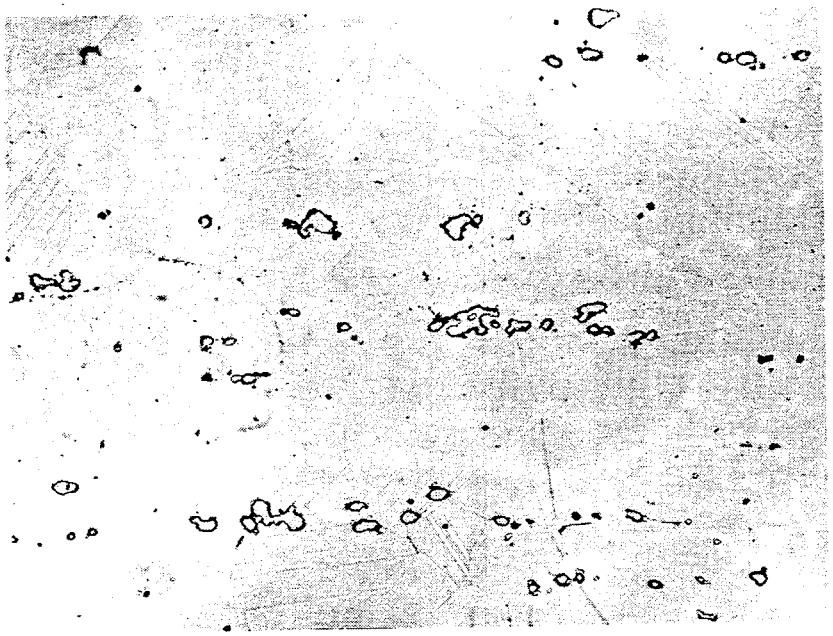
FIG. 3 is a reproduction of a photomicrograph of a second alloy conventionally processed.
Figure 4:
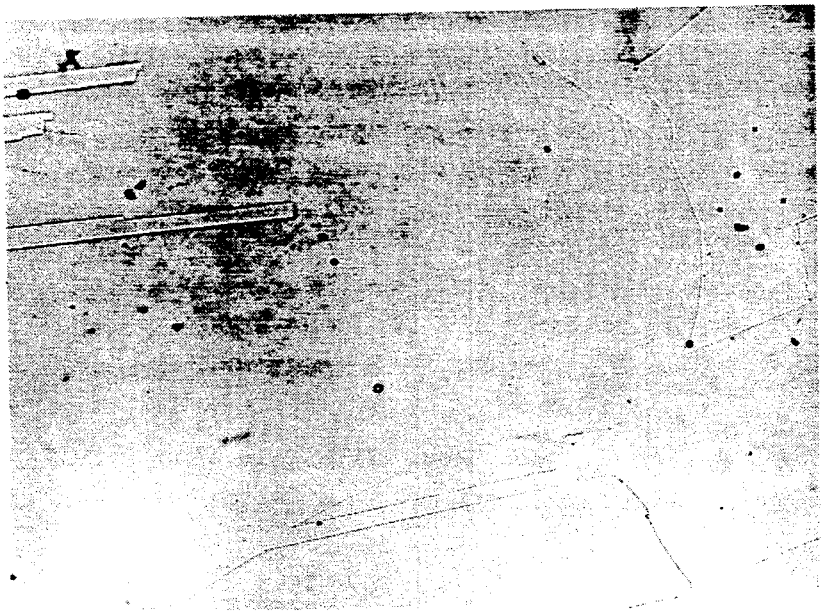
FIG. 4 is a reproduction of a photomicrograph of the second alloy processed using the homogenization treatment of the present invention.

Similar results were obtained for plate annealed at temperatures of 1149° C. and 1204° C., Table IV. Again, the significant beneficial effect of the homogenized alloys is evident. While the absolute optimum microstructure were not attained for the most highly alloyed compositions, the small amount of fine precipitate is more than satisfactory. Also, compare FIGS. 3 and 4 which depict Alloy 6 in the non-homogenized and homogenized conditions, respectively.

TABLE IV

| | | | | Hot Rolled + Annealed Plate Properties | | | | | | | |
|---|---|---|---|---|---|---|---|---|---|---|---|
| | | | | A (No Homogenization) | | | | B (Homogenized) | | | |
| | % by Wt | | | HR + 1149° C. ½ hr. WQ | | HR + 1204° C. ½ hr. WQ | | HR + 1149° C. ½ hr. WQ | | HR + 1204° C. ½ hr. WQ | |
| Alloy | Cr | Mo | W | Rb | *Micro | Rb | *Micro | Rb | *Micro | Rb | *Micro |
| 1 | 20.2 | 15.2 | 3.4 | 92 | large, mod. | 89 | fine, light | 89 | fine, light | 87 | OK |
| 2 | 21.0 | 15.2 | 3.4 | 93 | large, mod. | 91 | fine, mod. | 95 | fine, mod. | 83 | OK |
| 3 | 22.2 | 15.4 | 2.7 | 92 | large, mod. | 89 | large, mod. | 97 | fine, heavy | 85 | fine, light |
| 4 | 21.1 | 15.8 | 3.4 | 94 | large, heavy | 90 | large, mod. | 99 | fine, heavy | 88 | fine, very light |
| 5 | 20.9 | 16.4 | 3.5 | 95 | large, heavy | 92 | large, heavy | 101 | fine, heavy | 91 | fine, mod. |
| 6 | 20.9 | 15.4 | 3.9 | 96 | large, mod. | 92 | large, mod. | 97 | fine, heavy | 84 | fine, very light |
| 7 | 21.1 | 16.2 | 3.9 | 98 | large, heavy | 93 | large, heavy | 98 | different phase | 92 | different structure |
| 8 | 20.6 | 14.7 | 3.2 | 91 | large, mod. | 87 | fine, light | — | — | — | — |

TABLE IV-continued

| | | | | Hot Rolled + Annealed Plate Properties | | | | | | | |
|---|---|---|---|---|---|---|---|---|---|---|---|
| | | | | A (No Homogenization) | | | | B (Homogenized) | | | |
| | % by Wt | | | HR + 1149° C. ¼ hr. WQ | | HR + 1204° C. ¼ hr. WQ | | HR + 1149° C. ¼ hr. WQ | | HR + 1204° C. ¼ hr. WQ | |
| Alloy | Cr | Mo | W | Rb | *Micro | Rb | *Micro | Rb | *Micro | Rb | *Micro |
| 9 | 20.4 | 14.7 | 3.1 | 91 | — | — | — | 84 | OK | — | OK |
| 10 | 20.8 | 14.5 | 3.7 | — | fine, mod. | — | — | — | OK | — | — |

*Microstructure: Either large particles or finely dispersed particles, all transgranular, light, moderate or heavy amounts.

As was the case with plate, the homogenization treatment was beneficial to strip as reflected in Table V. Non-homogenized Alloys 3 and 5 did not roll satisfactory as was the case with Alloy 7. However, no attempt has been made to optimize processing parameters since the focus was on microstructure and crevice/pitting corrosion resistance.

TABLE V

| | | | | Cold Rolled + Annealed Strip Properties Annealed at 1204° C./¼ Hr, WQ | | | | | |
|---|---|---|---|---|---|---|---|---|---|
| | | | | A (No Homogenization) | | | B (Homogenized) | | |
| | | | | Hardness | | | Hardness | | |
| | % by Weight | | | As CR | CRA | | As CR | CRA | |
| Alloy | Cr | Mo | W | Rc | Rb | *Micro | Rc | Rb | *Micro |
| 1 | 20.2 | 15.2 | 3.4 | 38 | 87 | fine, light | 38 | 84 | fine, light |
| 2 | 21.0 | 15.2 | 3.4 | 40 | 88 | large, mod. | 38 | 86 | fine, light |
| 3 | 22.2 | 15.4 | 2.7 | — | — | — | 38 | 85 | fine, light |
| 4 | 21.1 | 15.8 | 3.4 | 41 | 88 | large, mod. | 39 | 85 | fine, light |
| 5 | 20.9 | 16.4 | 3.5 | — | — | — | 39 | 88 | large, light |
| 6 | 20.9 | 15.4 | 3.9 | 40 | 90 | large, mod. | 39 | 83 | fine, light |
| 7 | 21.1 | 16.2 | 3.9 | 41 | 92 | large, heavy | — | — | — |

*Microstructure: Either large particles or finely dispersed particles, all transgranular in light, moderate or heavy amounts.

Corrosion Results

Tables VI, VII and VIII reflect the beneficial effects in terms of corrosion resistance in 2% boiling hydrochloric acid (VI) and in the "Green Death" test (VII and VIII), the conditions being set forth in Tables. Alloy 12 was a 9091 kilogram commercial size heat the alloy containing 20.13% Cr, 14.05% Mo, 3.19% W, 0.004% C., 4.41% Fe, 0.23% Mn, 0.05% Si, 0.24% Al, 0.02% Ti, the balance nickel. Both the commercial and laboratory size heats performed well. It should be pointed out that temperatures of 125° and 130° C. was used for the so-called "Green Death" test since the conventionally used test temperature of 100° C. did not reveal any crevice corrosion over the test period of 24 hours. No pitting or general corrosion was observed.

TABLE VI

| | | General Corrosion Resistance Boiling 2% HCL - 7 Day Test With Duplicate Specimens 0.152–0.254 cm Sheet | | |
|---|---|---|---|---|
| | | Corrosion Rate, micro-meters/Yn | | |
| Alloy | Condition | No. 1 | No. 2 | Average |
| 12 | B | 1270 | 1270 | 1270 |
| 1 | A | 660 | 635 | 660 |
| | B | 635 | 635 | 635 |
| 6 | A | 610 | 711 | 660 |
| | B | 203 | 254 | 229 |

Condition A - No homogenization prior to hot rolling
Condition B - Homogenized at 1246° C./10 hr prior to hot rolling

TABLE VII

| | | Crevice Corrosion Date for Conventionally Processed Commercial Sheet and Plate, Evaluated in the Green Death* for 24 Hours at 125° C. | |
|---|---|---|---|
| Alloy | Mill Form | Percent of Crevices Attacked** | Maximum Crevice Pit Depth Micrometers |
| 12 | 1/16" sheet | (a) | 21 | 1651 |
| | | (b) | 29 | 1219 |
| | | Average | 25 | 1448 |
| 12 | ¼" plate | (a) | 4 | 51 |
| | | (b) | 0 | 51 |
| | | (c) | 4 | 0 |
| | | (d) | 25 | 1016 |
| | | Average | 9 | 279 |

Green Death: 11.9% $H_2SO_4$ + 1.3% HCl + 1% $FeCl_3$ + 1% $CuCl_2$ balance water (% by wt.)
**Teflon TM (polytetrafluoroethylene) washers, 12 crevices per washer (24 crevices per specimen), torqued to 0.28 Newton-meter.

TABLE VIII

| | | Crevice Corrosion Test Results Laboratory Produced Strip and Plate - Annealed Creviced Specimen Exposed to Green Death* Environment for 24 Hr at Temperature Indicated | | |
|---|---|---|---|---|
| Alloy | Condition | Temp., °C. | Percent of Crevices Attacked | Max. Crevice Depth Micro-meters |
| 10 | A | 125 | 0,4 | 0, 75 |
| | A | 125 | 0,4 | 0, <02 |
| 10 | B | 125 | 0,8 | 0, 152 |
| | B | 125 | 0,0 | 0, 0 |
| 11 | A | 125 | 0,50 | 0, 635 |
| | B | 125 | 0,0 | 0, 0 |
| 6 | A | 125 | 0,0 | 0, 0 |
| | B | 125 | 0,0 | 0, 0 |
| 6 | A | 130 | 0,4,17 | 0, <50, <50 |
| | B | 130 | 0,0,4 | 0, 0, <50 |

Condition A - No homogenization prior to hot rolling.
Condition B - Homogenized at 1246° C. prior to hot rolling.
*Green Death - 11.9% $H_2SO_4$ + 1.3% HCl + 1% $FeCl_3$ + 1% $CuCl_2$ balance water.

Various alloys were also subjected to the ASTM G-28, Practice "B" test, a discriminating test used to assess corrosion of the intergranular type. Test specimens were exposed over what is considered to be the sensitization temperature or temperature range, roughly 760° to 982° C., this temperature being deemed a yardstick as to predicting corrosion attack, and then immersed in Boiling 23% $H_2SO_4$+1.2% HC+1% $CuCl_2$+1% $FeCl_3$ balance water for the standard 24 hour period. Practice "B" is considered more severe and reliable than the g-28, Practice"A" test procedure in predicting attack. (Practice A procedure employs a corroding solution made up by disolving 25 grams of $Fe_2(SO_4)_3$ $9H_2O$ in 600 ml of an aqueous solution containing 50% $H_2SO_4$ by weight). Data are presented in Tables X and XI. Included is Alloy X which corresponds to Alloy C-276 and the chemistry is given in Table IX.

TABLE IX

| Alloy | Cr | Mo | W | Fe | C | Si | Mn | B | Al | Ti | Ni |
|---|---|---|---|---|---|---|---|---|---|---|---|
| X | 15.05 | 15.55 | 3.76 | 5.79 | .001 | .051 | .45 | — | .47 | .02 | Bal. |

TABLE X

Intergranular Attack Resistance in ASTM G-28, Practice B
Laboratory Produced 0.254 cm Strip Annealed at 1204° C.

| | | Corrosion Rate micrometers per year | | | |
|---|---|---|---|---|---|
| Alloy | Condition | As Ann. | 760/1 | 871/1 | 982/1*** |
| 8 and 9 | A | 228 | 254 | 11,760 | 1,041 |
| | B | 203 | 254 | 2,565 | 356 |
| 1 | A | 279 | 508 | 4,648 | 1,067 |
| | B | 254 | 432 | 1,422 | 711 |
| 6 | A | 254 | 6,248 | 85,725 | 84,734 |
| | B | 254 | 254 | 1,295 | 660 |
| 10 | A | — | 34,696 | 56,388 | 44,171 |
| | B | — | 3,783 | 66,853 | 3,505 |
| X* | A | 1981 | — | 23,596 | 27,940 |
| X** | A | 1524 | — | 30,632 | 31,775 |

NOTE: Alloy 10 annealed at 1149° C.
Condition A - No homogenization prior to hot rolling at 1149° C.
Condition B - Homogenized at 1246° C./10 hr prior to hot rolling at 1149° C.
*0.47 cm sheet
**0.16 cm sheet
***Temperature (°C.)/Time (hours)

As depicted in Table X, the homogenization treatment is generally beneficial even in respect of intergranular attack. Alloy 10 was annealed at 1149° C. It did not behave as well as the alloys annealed at 1204° C. The effect of reheating on commercial plate and sheet is given in Table XI below.

TABLE XI

Effect of Reheat Temperature on Intergranular Attack in ASTM G-28, Practice B
Commercially Produced Plate and Sheet

| | Corrosion Rate* | |
|---|---|---|
| Condition | Plate Alloy 12 | Sheet Alloy 12 |
| MA + 649° C./1 hr | 178 | 2,038 |
| MA + 760° C./1 hr | 228 | 51,358 |
| MA + 871° C./1 hr | 686 | 50,342 |
| MA + 982° C./1 hr | 228 | 1,905 |
| MA + 1093° C./1 hr | 203 | 203 |

MA — Mill Anneal
*Micrometers per year

While the principal thrust of the subject invention is directed to corrosion of the crevice/pitting type as well as general corrosion, it is considered that the invention would be of advantage in respect of other forms of corrosive attack, including intergranular, stress-corrosion cracking induced by, for example, chlorides, sulfide stress cracking, etc. In addition, while the subject invention is concerned by far and large with the high chromium/molybdenum/tungsten alloys described herein, it is deemed that alloys of lower levels of such constituents, e.g., down to 15% chromium and down to 12% molybdenum and up to 4% tungsten can be treated in accordance herewith.

In addition to the foregoing, it has also been discovered that by controlling the amount of iron and the weight ratio of titanium to carbon in nickel-base alloys amenable to the special heat treatment of the present invention, highly advantageous results in terms of corrosion resistance can be achieved when such alloys are heat treated as described hereinbefore. The additional discoveries involved holding the iron content of the alloys to less than about 2.5% (by weight) and preferably to less than about 1% by weight. When iron is thus controlled the molybdenum content of the alloys can be as high as 17%, e.g., about 12 to 17% while still attaining excellent corrosion resistance. The discoveries also involve maintaining in the alloys a weight ratio of titanium to carbon of at least about 1 and up to 10 or higher. When the Ti/C is maintained above 1 and, especially when carbon is maintained below a maximum of 0.015% by weight, advantageous results are obtained, in terms of resistance to intergranular corrosive attack as measured by standard tests with alloys heat treated in accordance with the process of the present invention.

By virtue of these discoveries, the present invention contemplates novel alloy compositions comprising, in percent by weight, 19 to 23% chromium, 14 to 17% molybdenum, 2 to 4% tungsten, 0 to 0.1% carbon, titanium in an amount such that the weight ratio of titanium to carbon is at least 1, 0 to 2.5% iron, balance essentially nickel together with small amounts of incidental elements, e.g., manganese, silicon, aluminum, cobalt and niobium and impurities which together do not detrimentally affect the novel characteristics of the alloy. Advantageously, the novel alloy compositions contain less than about 0.02% carbon and the weight ratio of titanium to carbon is from about 3 to 1, to about 15 to 1, e.g., 10 to 1. For reasons not fully understood, low iron content, e.g., below about 2.5% especially together with a high Ti/c weight ratio results in alloys which are particularly resistant to the formation of Mu phase after homogenization as disclosed hereinbefore and reheating in the range of 760° C. to 982° C. This resistance, as evidenced by resistance to intergranular corrosion attack under the conditions of ASTM G28 practice B test, is set forth hereinafter.

Alloy compositions as set forth in Table XII were produced as described hereinbefore in connection with Table II and treated by homogenization as were the series B ingots discussed hereinbefore, i.e., soaked 1204° C. for 6 hours followed by holding for 10 hours at 1246° C.

TABLE XII

| Alloy | C | Mn | Fe | Si | Ni | Cr | Al | Ti | Nb | Mo | W |
|---|---|---|---|---|---|---|---|---|---|---|---|
| 10 | .002 | .25 | 4.50 | .05 | 55.67 | 20.76 | .14 | .021 | .001 | 14.54 | 3.67 |
| 13 | .002 | .24 | 5.98 | .08 | 56.59 | 19.49 | .21 | .027 | .004 | 13.89 | 3.24 |
| 14 | .008 | .27 | 3.72 | .13 | 57.39 | 20.44 | .19 | .035 | .009 | 14.24 | 3.34 |
| 15 | .002 | .24 | 2.46 | .06 | 58.55 | 20.44 | .21 | .0005 | .005 | 14.32 | 3.33 |
| 16 | .004 | .25 | 1.13 | .07 | 59.67 | 20.38 | .21 | .022 | .007 | 14.50 | 3.36 |
| 17 | .003 | .24 | .65 | .06 | 60.16 | 20.46 | .22 | .0003 | .001 | 14.40 | 3.35 |
| 18 | .005 | .26 | .24 | .06 | 60.62 | 20.46 | .22 | .036 | .006 | 14.30 | 3.34 |
| 19 | .003 | .24 | 1.01 | .06 | 57.22 | 20.56 | .20 | .0014 | .001 | 16.30 | 3.89 |
| 20 | .003 | .24 | .01 | .05 | 58.72 | 20.42 | .20 | .0093 | .002 | 16.53 | 3.37 |

Alloy Nos. 15, 16, 18 and 20 in Table XII are examples of the highly improved novel alloys which have been discovered. Alloy 17 and 19 with low iron have low weight ratios of titanium to carbon.

Table XIII sets forth results of ASTM-G28 Practice B test on alloys of Table XII which, after initial homogenization followed by hot rolling, have been cold rolled, annealed at 1204° C. for 174 hour water quenched and reheated for one hour as specified.

TABLE XIII

Corrosion Rate in Micrometers per year - ASTM G-28, B
Cold Roll + Anneal at 1204° C. + Reheat °C./hr

| Alloy No. | Iron % | Ti/C | 760/1 | 871/1 | 982/1 | Average |
|---|---|---|---|---|---|---|
| 13 | 6.0 | 13.5 | 254<br>229 | 1,194<br>2,413 | 103,022<br>305 | 17,907 |
| 10 | 4.4 | 10.5 | 1,143<br>457 | 84,379<br>88,849<br>64,287 | 7,036<br>1,905 | 35,433 |
| 14 | 3.7 | 4.4 | 69,875<br>58,903 | 63,017<br>47,980 | 483<br>356 | 45,923 |
| 15 | 2.5 | 0.25 | 11,151<br>356 | 254<br>254 | 889<br>229 | 1,905 |
| 16 | 1.1 | 5.5 | 203<br>178 | 229<br>203 | 279<br>203 | 203 |
| 17 | 0.7 | 0.10 | 1,575<br>8,712 | 71,297<br>40,970 | 279<br>330 | 17,628 |
| 18 | 0.2 | 7.2 | 203<br>178<br>203 | 254<br>203 | 305<br>203 | 229 |
| 19 | 1.0 | 0.5 | 305 | 508<br>533 | 813 | 533 |
| 20 | 0.0 | 3.1 | 279<br>305 | 279 | 508 | 356 |

Results similar to those presented in Table XIII but obtained on identically treated alloy samples tested in the less discriminating ASTM G28 practice A test as set forth in Table XIV.

TABLE XIV

Corrosion Rate in micrometers per year - ASTM G-28, A
Cold Roll + Anneal at 1204° C. + Reheat °C./hr

| Alloy No. | Iron % | Ti/C | 760/1 | 871/1 | 980/1 | Average |
|---|---|---|---|---|---|---|
| 13 | 6.0 | 13.5 | 1,829 | 1,854 | 1,930 | 1,879 |
| 10 | 4.4 | 10.5 | 1,413 | 3,150<br>3,479 | 3,404 | 2,870 |
| 14 | 2.7 | 4.4 | 2,311 | 4,902<br>5,156 | 2,134 | 3,632 |
| 15 | 2.5 | 0.25 | 1,702 | 2,464<br>4,293 | 1,321 | 2,438 |
| 16 | 1.1 | 5.5 | 1,575 | 1,295<br>1,321 | 1,118 | 1,321 |
| 17 | 0.7 | 0.10 | 1,651 | 1,270<br>1,270 | 1,930 | 1,524 |
| 18 | 0.2 | 7.2 | 1,219 | 1,270<br>1,219 | 1,168 | 1,219 |
| 19 | 1.0 | 0.47 | 3,251 | 5,563<br>6,883 | 10,566 | 6,553 |
| 20 | 0.0 | 3.1 | 2,540 | 3,200<br>4,064 | 5,944 | 3,937 |

Together, Tables XIII and XIV show that Alloys Nos. 15, 16 and 18 to 20 exhibit advantageous corrosion resistance attributable to iron contents less than about 2.5% together with titanium to carbon ratios in excess of about 0.2. When iron is low, carbon is less than about 0.01%, e.g., less than 0.008% and the titanium to carbon ratio is in excess of 1, e.g., greater than about 3 as in alloys Nos. 16, 18 and 20 the best results are obtained.

An additional advantage of the alloys of the present invention is demonstrated by the data in Table XV.

TABLE XV

Oxidation - Air + 5% H2O at 1100° C.
Mass Loss (Mg/cm$^2$) in hours indicated

| Alloy No. | Iron % | 168 hr. | 336 hr. | 504 hr. | 528 hr. | 696 hr. | 840 hr. | 1032 hr. | 1200 hr. |
|---|---|---|---|---|---|---|---|---|---|
| 13 | 5.98 | 1.8 | 3.9 | — | 9.6 | 15.3 | 20.9 | 37.3 | 75.0 |
| 18 | 0.24 | 1.0 | 3.0 | — | 4.6 | 6.5 | 9.9 | 16.4 | 23.2 |
| *625 | 2.5 | — | — | 238.0 | — | — | — | — | — |
| *C-276 | 5.5 | — | — | 328.0 | — | — | — | — | — |

*nominal composition
INCONEL TM alloy 625 61Ni—21.5Cr—9Mo—3.6Nb—2.5Fe
INCO alloy C-276 55Ni—15.5Cr—16Mo—4W—5.5Fe—2.5Co The data in Table XV shows that alloy 18 is roughly 3 times more resistant to oxidation in moist air at 1100° C. than alloy 13 and between 1 and 2 orders of magnitude more resistant to the same conditions than are well-known corrosion-resistant commercial alloys.

It is to be noted that the homogenization treatment of the present invention is particularly effective when carried out prior to hot working, e.g., rolling and even more so when carried out both before and after hot working. Nevertheless, some useful improvement in corrosion resistance may be attained by homogenization after hot working.

Although the present invention has been described in conjunction with preferred embodiments, it is to be understood that modifications and variations may be resorted to without departing from the spirit and scope of the invention, as those skilled in the art will understand. In terms of ranges of alloying constituents, the given percentage of an element may be used with a given percentage of one or more of the other elements. This specification includes any numerical value within a given elemental range and any given range of heat treatment.

The embodiments of the invention in which an exclusive property or privilege is claimed are defined as follows:

1. A process for enhancing crevice and pitting corrosion resistance of nickel-base alloys of high combined percentages of chromium, molybdenum and tungsten in various corrosive media by minimizing the formation of deleterious quantities of Mu phase which comprises subjecting an alloy consisting essentially of in weight percent about 19 to 23% chromium, about 14 to 17% molybdenum, about 2 to 4% tungsten, about 0 to about 0.1% carbon, about 0 to 0.25% titanium, about 0 to about 10% iron and the balance essentially nickel, to a homogenization treatment within the temperature range of above 1149° C. to about 1316° C. for a period of at least about 5 hours.

2. The process set forth in claim 1 in which the homogenization temperature is from about 1190° C. to about 1260° C. and the holding period is from 5 to 50 hours.

3. The process set forth in claim 1 in which the homogenization treatment is carried out in two-stages comprised of heating the alloy from about 1093° C. to 1204° C. for about 5 to 50 hours and thereafter heating the alloy for about 5 to 72 hours at about 1204° C. to 1316° C.

4. The process set forth in claim 3 in which the alloy contains about 20 to about 23% chromium, about 14.25 to about 16% molybdenum, about 2.5 to about 4% tungsten, up to about 0.05% carbon, about 2 to about 10% iron, up to about 0.5% manganese and up to about 0.25% silicon.

5. The process set forth in claim 1 in which the alloy contains chromium from about 21.5 to about 23% and the molybdenum is from about 14 to about 15%.

6. The process set forth in claim 1 in which the alloy contains about 19.5 to about 21.5% chromium and about 15 to about 16% molybdenum.

7. A process for enhancing crevice and pitting corrosion resistance of nickel-base alloys of high combined percentages of chromium and molybdenum in various corrosive media by minimizing the formation of deleterious quantities of Mu phase which comprises subjecting an alloy consisting essentially in percent by weight of 19 to 25% chromium, about 12 to about 18% molybdenum, up to 4% tungsten, up to 0.1% carbon and the balance essentially nickel to a homogenization treatment over the temperature range of above 1149° C. to about 1316° C. for a period of about 5 to 100 hours.

8. The process set forth in claim 7 in which the holding period is for about 10 to 100 hours.

9. The process set forth in claim 7 in which the homogenization temperature is from about 1190° C. to about 1260° C. and the holding period is from about 5 to 50 hours.

10. A nickel-base alloy having enhanced resistance to crevice and pitting corrosion and characterized by minimal quantities of deleterious Mu phase consisting essentially in weight percent of about 19 to 23% chromium, about 14 to 17% molybdenum, about 2 to 4% tungsten, about 0 to about 0.1% carbon, about 0 to about 0.25% titanium, about 0 to about 10% iron and the balance being essentially nickel, said alloy being in a condition resulting from homogenization within the temperature range of above 1149° C. to about 1316° C. for a period of at least about 5 hours prior to hot working and subsequent conventional processing.

11. A nickel-base alloy as in claim 10 in a condition resulting from homogenization at 1190° C. to 1260° C. for 5 to 50 hours, hot working and subsequent conventional processing.

12. A nickel-base alloy as in claim 10 in a condition resulting from homogenization at 1093° to 1204° C. for 5 to 50 hours and at 1204° C. to 1316° C. for 5 to 72 hours, hot working and subsequent conventional processing.

13. A nickel-base alloy particularly characterized by enhanced oxidation resistance, enhanced crevice and pitting corrosion resistance and by absence of deleterious quantities of Mu phase after homogenization within the temperature range of about 1149° C. to about 1316° C. for a period of about 5 to 100 hours even when reheated in the range of 760° to 982° C. consisting essentially in weight percent, of about 19 to 23% chromium, about 14 to 17% molybdenum, about 2 to 4% tungsten, about 0 to 0.1% carbon, titanium up to 0.25% in an amount such that the weight ratio of titanium to carbon is at least about 1, about 0 to 2.5% iron the balance being essentially nickel together with small amounts of impurities and incidental elements which do not detrimentally alter the basic and novel characteristics of the alloy.

14. A nickel-base alloy as in claim 13 containing less than 0.02% carbon.

15. A nickel-base alloy as in claim 13 containing less than about 2% iron, less than 0.01% carbon and having a titanium to carbon weight ratio greater than about 3.

* * * * *